US011145967B2

(12) United States Patent
Fang et al.

(10) Patent No.: US 11,145,967 B2
(45) Date of Patent: Oct. 12, 2021

(54) ANTENNA SYSTEM

(71) Applicant: Wistron Corp., New Taipei (TW)

(72) Inventors: Ying-Sheng Fang, New Taipei (TW); Nien-Chao Chuang, New Taipei (TW); Po-Tsang Lin, New Taipei (TW); Chia-Wei Su, New Taipei (TW)

(73) Assignee: WISTRON CORP., New Taipei (TW)

( * ) Notice: Subject to any disclaimer, the term of this patent is extended or adjusted under 35 U.S.C. 154(b) by 112 days.

(21) Appl. No.: 16/710,586

(22) Filed: Dec. 11, 2019

(65) Prior Publication Data

US 2021/0126356 A1 Apr. 29, 2021

(30) Foreign Application Priority Data

Oct. 29, 2019 (TW) ..... 108138963

(51) Int. Cl.
*H01Q 1/24* (2006.01)
*H01Q 1/52* (2006.01)
*H01Q 5/307* (2015.01)

(52) U.S. Cl.
CPC ..... *H01Q 1/521* (2013.01); *H01Q 5/307* (2015.01); *H01Q 1/242* (2013.01)

(58) Field of Classification Search
CPC ..... H01Q 1/521; H01Q 5/307; H01Q 1/242
See application file for complete search history.

(56) References Cited

U.S. PATENT DOCUMENTS

2007/0001911 A1 1/2007 Fujio et al.
2007/0139270 A1* 6/2007 Takei ..... H01Q 1/38 343/700 MS
2009/0256754 A1* 10/2009 Tsai ..... H01Q 25/00 343/700 MS (Continued)

FOREIGN PATENT DOCUMENTS

KR 20170061295 A * 6/2017
TW M337864 U 8/2008

OTHER PUBLICATIONS

Chinese language office action dated Jul. 21, 2020, issued in application No. TW 108138963.

(Continued)

*Primary Examiner* — Dieu Hien T Duong
(74) *Attorney, Agent, or Firm* — McClure, Qualey & Rodack, LLP

(57) ABSTRACT

An antenna system includes a first antenna, a second antenna, a first parasitic element, and a second parasitic element. The first antenna includes a first feeding element, a first radiation element, and a shorting element. The first radiation element is coupled to the first feeding element. The first feeding element is coupled through the shorting element to a first grounding point. The second antenna includes a second feeding element, a second radiation element, and a third radiation element. The second radiation element and the third radiation element are coupled to the second feeding element. The first parasitic element is coupled to a second grounding point. The second parasitic element is coupled to (Continued)

a third grounding point. The first parasitic element and the second parasitic element are disposed between the first and second antennas. The first parasitic element and the second parasitic element extend away from each other.

19 Claims, 4 Drawing Sheets

(56) References Cited

U.S. PATENT DOCUMENTS

| | | | | |
|---|---|---|---|---|
| 2011/0134014 | A1* | 6/2011 | Kondo | H01Q 21/30 343/876 |
| 2013/0099980 | A1* | 4/2013 | Hayashi | H01Q 9/42 343/700 MS |
| 2014/0313089 | A1 | 10/2014 | Wu et al. | |
| 2017/0012345 | A1* | 1/2017 | Zhang | H01Q 1/243 |

OTHER PUBLICATIONS

Indian Office Action dated Mar. 31, 2021 in corresponding application IN 201924053313.

* cited by examiner

ANTENNA SYSTEM

CROSS REFERENCE TO RELATED APPLICATIONS

This Application claims priority of Taiwan Patent Application No. 108138963 filed on Oct. 29, 2019, the entirety of which is incorporated by reference herein.

BACKGROUND OF THE INVENTION

Field of the Invention

The disclosure generally relates to an antenna system, and more particularly, to an antenna system for improving isolation.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna system is indispensable in any mobile device supporting wireless communication. However, since the interior space in a mobile device is very limited, multiple antennas are usually disposed close to each other, and such a design causes serious interference between antennas. As a result, there is a need to design a new antenna system for solving the problem of bad isolation in conventional antenna systems.

BRIEF SUMMARY OF THE INVENTION

In an exemplary embodiment, the invention is directed to an antenna system that includes a first antenna, a second antenna, a first parasitic element, and a second parasitic element. The first antenna includes a first feeding element, a first radiation element, and a shorting element. The first feeding element has a first feeding point. The first radiation element is coupled to the first feeding element. The first feeding element is coupled through the shorting element to a first grounding point. The second antenna includes a second feeding element, a second radiation element, and a third radiation element. The second feeding element has a second feeding point. The second radiation element is coupled to the second feeding element. The third radiation element is coupled to the second feeding element. The second radiation element and the third radiation element substantially extend in opposite directions. The first parasitic element is coupled to a second grounding point. The second parasitic element is coupled to a third grounding point. The first parasitic element and the second parasitic element are disposed between the first antenna and the second antenna. The first parasitic element and the second parasitic element substantially extend away from each other.

In some embodiments, the antenna system further includes a nonconductive supporting element configured to support the first antenna, the second antenna, the first parasitic element, and the second parasitic element. The nonconductive supporting element has a first surface and a second surface which are not parallel to each other.

In some embodiments, the first radiation element substantially has a U-shape.

In some embodiments, the first radiation element extends from the first surface onto the second surface of the nonconductive supporting element.

In some embodiments, the shorting element has a meandering shape.

In some embodiments, the shorting element is positioned on the first surface of the nonconductive supporting element.

In some embodiments, the second radiation element substantially has a relatively short straight-line shape.

In some embodiments, the second radiation element is positioned on the first surface of the nonconductive supporting element.

In some embodiments, the third radiation element substantially has a relatively long straight-line shape.

In some embodiments, the third radiation element is positioned on the first surface of the nonconductive supporting element.

In some embodiments, the first parasitic element substantially has an inverted L-shape.

In some embodiments, the first parasitic element extends from the first surface onto the second surface of the nonconductive supporting element.

In some embodiments, the second parasitic element substantially has an L-shape.

In some embodiments, the second parasitic element extends from the first surface onto the second surface of the nonconductive supporting element.

In some embodiments, the first antenna and the second antenna cover a first frequency band from 2496 MHz to 2690 MHz, and a second frequency band from 3300 MHz to 3800 MHz.

In some embodiments, the total length of the first feeding element and the first radiation element is from 0.15 to 0.2 wavelength of the first frequency band.

In some embodiments, the total length of the first feeding element and the shorting element is from 0.3 to 0.4 wavelength of the second frequency band.

In some embodiments, the total length of the second feeding element and the second radiation element is from 0.1 to 0.12 wavelength of the second frequency band.

In some embodiments, the total length of the second feeding element and the third radiation element is from 0.12 to 0.14 wavelength of the first frequency band.

In some embodiments, the distance between the first parasitic element and the second parasitic element is from 1.1 mm to 2 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
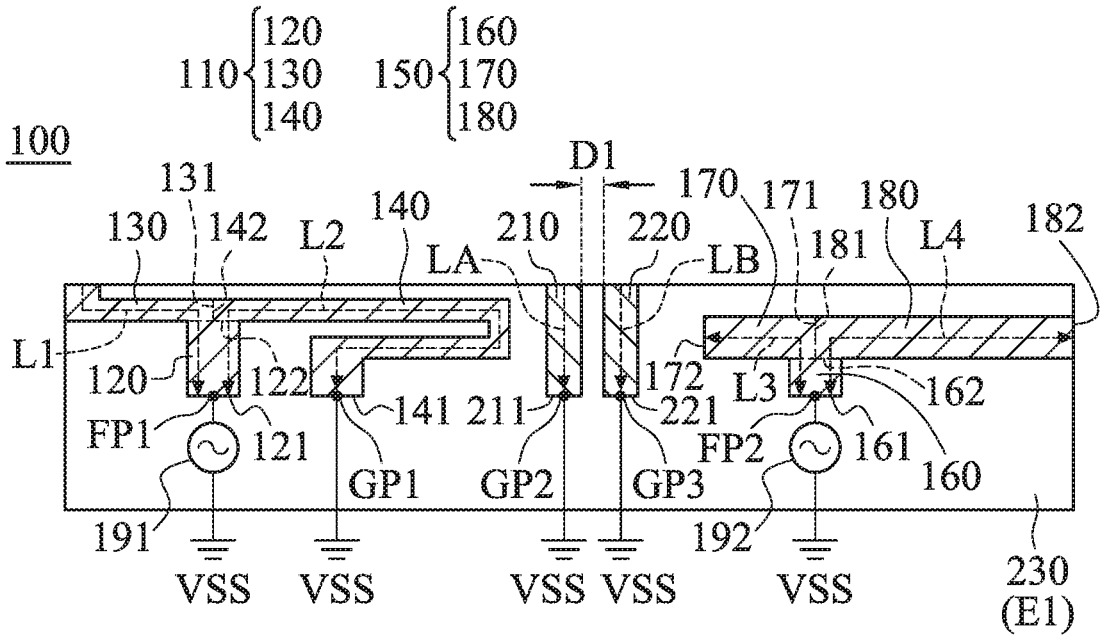
FIG. 1 is a front view of an antenna system according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Figure 2:
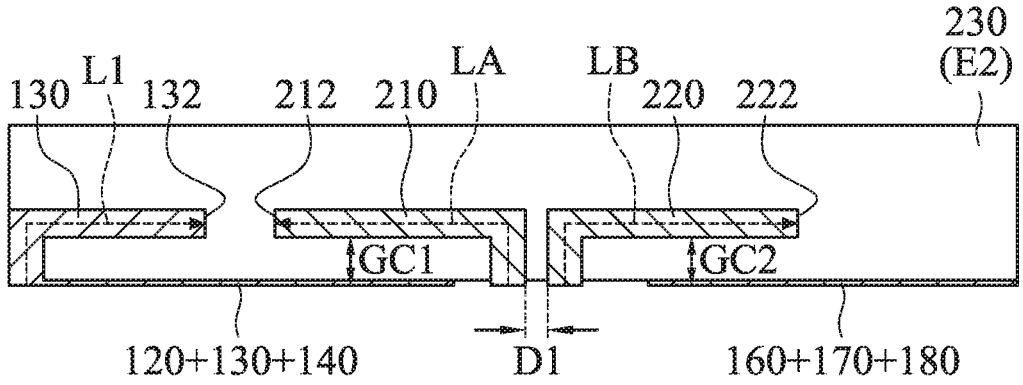
FIG. 2 is a top view of an antenna system according to an embodiment of the invention.

FIG. 1 is a front view of an antenna system 100 according to an embodiment of the invention. FIG. 2 is a top view of the antenna system 100 according to an embodiment of the invention. Please refer to FIG. 1 and FIG. 2 together. The antenna system 100 may be applied to a mobile device, such as a smartphone, a tablet computer, or a notebook computer. As shown in FIG. 1 and FIG. 2, the antenna system 100 at least includes a first antenna 110, a second antenna 150, a first parasitic element 210, and a second parasitic element 220. Both the first parasitic element 210 and the second parasitic element 220 are disposed between the first antenna 110 and the second antenna 150. The first antenna 110, the second antenna 150, the first parasitic element 210, and the second parasitic element 220 may all be made of metal materials, such as copper, silver, aluminum, iron, or their alloys.

In some embodiments, the antenna system 100 further includes a nonconductive supporting element 230, which may be made of a plastic material. The nonconductive supporting element 230 is configured to support the first antenna 110, the second antenna 150, the first parasitic element 210, and the second parasitic element 220. The nonconductive supporting element 230 may have a first surface E1 and a second surface E2 which are not parallel to each other, such that the antennas and parasitic elements of the antenna system 100 distributed thereon form a 3D (Three-Dimensional) structure. For example, the first surface E1 and the second surface E2 may be two planes which are adjacent to and perpendicular to each other. However, the invention is not limited thereto. In alternative embodiments, there is a different angle (e.g., 30, 45, or 60 degrees) formed between the first surface E1 and the second surface E2, or the first surface E1 is parallel to and overlaps the second surface E2, such that the antennas and parasitic elements of the antenna system 100 distributed thereon form a planar structure.

The first antenna 110 has a first feeding point FP1. The first feeding point FP1 may be coupled to a first signal source 191, such as an RF (Radio Frequency) module, for exciting the first antenna 110. In addition, the first antenna 110 includes a first feeding element 120, a first radiation element 130, and a shorting element 140.

The first feeding element 120 may substantially have a rectangular shape or a straight-line shape. The whole first feeding element 120 may be disposed on the first surface E1 of the nonconductive supporting element 230. Specifically, the first feeding element 120 has a first end 121 and a second end 122. The first feeding point FP1 is positioned at the first end 121 of the first feeding element 120.

The first radiation element 130 may substantially have a U-shape. The first radiation element 130 may extend from the first surface E1 onto the second surface E2 of the nonconductive supporting element 230. Specifically, the first radiation element 130 has a first end 131 and a second end 132. The first end 131 of the first radiation element 130 is coupled to the second end 122 of the first feeding element 120. The second end 132 of the first radiation element 130 is an open end.

The shorting element 140 may have a meandering shape. The whole shorting element 140 may be disposed on the first surface E1 of the nonconductive supporting element 230. Specifically, the shorting element 140 has a first end 141 and a second end 142. The first end 141 of the shorting element 140 is coupled to a first grounding point GP1. The second end 142 of the shorting element 140 is coupled to the second end 122 of the first feeding element 120. Thus, the first feeding element 120 is coupled through the shorting element 140 to the first grounding point GP1. For example, the first grounding point GP1 may be at a first position on a ground element (not shown), and the ground element can provide a ground voltage VSS.

The second antenna 150 has a second feeding point FP2. The second feeding point FP2 may be coupled to a second signal source 192, such as another RF module, for exciting the second antenna 150. In addition, the second antenna 150 includes a second feeding element 160, a second radiation element 170, and a third radiation element 180.

The second feeding element 160 may substantially have a rectangular shape or a straight-line shape. The whole second feeding element 160 may be disposed on the first surface E1 of the nonconductive supporting element 230. Specifically, the second feeding element 160 has a first end 161 and a second end 162. The second feeding point FP2 is positioned at the first end 161 of the second feeding element 160.

The second radiation element 170 may substantially have a relatively short straight-line shape. The whole second radiation element 170 may be disposed on the first surface E1 of the nonconductive supporting element 230. Specifically, the second radiation element 170 has a first end 171 and a second end 172. The first end 171 of the second radiation element 170 is coupled to the second end 162 of the second feeding element 160. The second end 172 of the second radiation element 170 is an open end. The second end 132 of the first radiation element 130 and the second end 172 of the second radiation element 170 may substantially extend in opposite directions and toward each other.

The third radiation element 180 may substantially have a relatively long straight-line shape. The whole third radiation element 180 may be disposed on the first surface E1 of the nonconductive supporting element 230. Specifically, the third radiation element 180 has a first end 181 and a second end 182. The first end 181 of the third radiation element 180 is coupled to the second end 162 of the second feeding element 160. The second end 182 of the third radiation element 180 is an open end. The second end 172 of the second radiation element 170 and the second end 182 of the third radiation element 180 may substantially extend in opposite directions and away from each other. In some embodiments, the combination of the second feeding element 160, the second radiation element 170, and the third radiation element 180 substantially has a T-shape.

The first parasitic element 210 may substantially have an inverted L-shape. The first parasitic element 210 may extend from the first surface E1 onto the second surface E2 of the nonconductive supporting element 230. Specifically, the first parasitic element 210 has a first end 211 and a second end 212. The first end 211 of the first parasitic element 210 is coupled to a second grounding point GP2. The second end 212 of the first parasitic element 210 is an open end. The second grounding point GP2 may be at a second position on the ground element, and the second position may be different from the aforementioned first position. A first coupling gap GC1 may be formed between the first parasitic element 210 and the shorting element 140.

The second parasitic element 220 may substantially have an L-shape. The second parasitic element 220 may extend from the first surface E1 onto the second surface E2 of the nonconductive supporting element 230. Specifically, the second parasitic element 220 has a first end 221 and a second end 222. The first end 221 of the second parasitic element 220 is coupled to a third grounding point GP3. The second end 222 of the second parasitic element 220 is an open end. The third grounding point GP3 may be at a third position on the ground element, and the third position may be different from the aforementioned first position and second position. The second end 212 of the first parasitic element 210 and the second end 222 of the second parasitic element 220 may substantially extend in opposite directions and away from each other. A second coupling gap GC2 may be formed between the second parasitic element 220 and the second radiation element 170. In some embodiments, the first parasitic element 210 and the second parasitic element 220 are symmetrical with respect to the central line of the antenna system 100.

Figure 3:
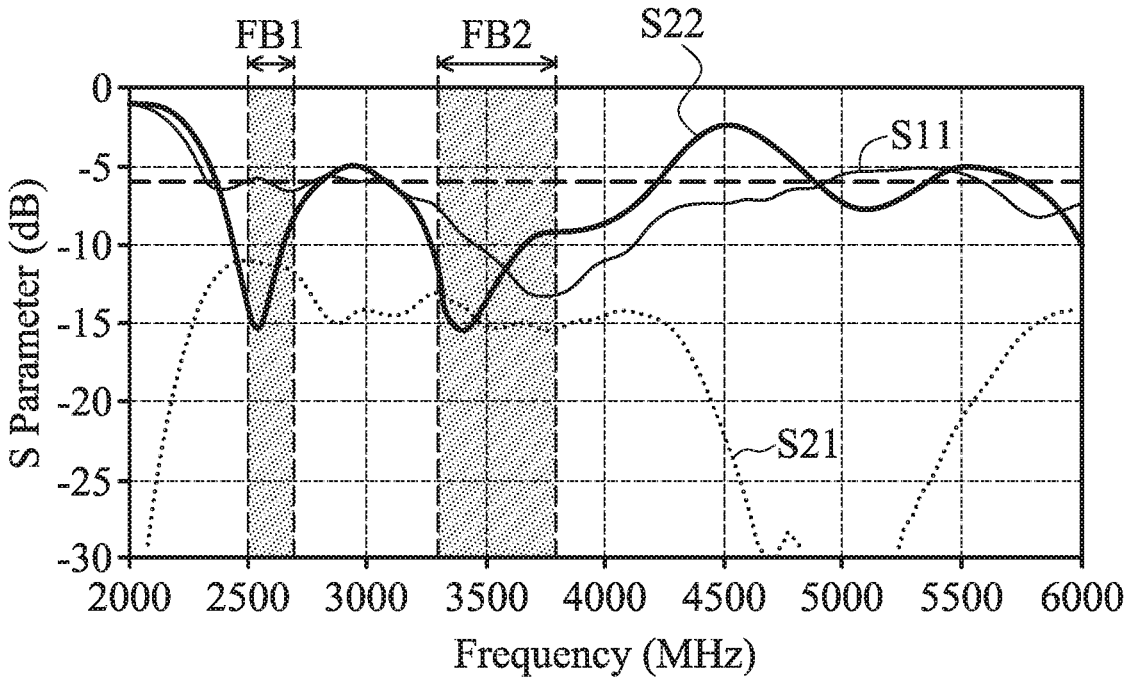
FIG. 3 is a diagram of S-parameters of an antenna system according to an embodiment of the invention.

FIG. 3 is a diagram of S-parameters of the antenna system 100 according to an embodiment of the invention. The horizontal axis represents the operation frequency (MHz), and the vertical axis represents the S-parameters. If the first feeding point FP1 is set as a first port (Port 1) and the second feeding point FP2 is set as a second port (Port 2), FIG. 3 illustrates an S11-parameter curve S11 relative to the first antenna 110, an S22-parameter curve relative S22 to the second antenna 150, and an S21-parameter curve S21 between the first antenna 110 and the second antenna 150. According to the measurement of FIG. 3, both the first antenna 110 and the second antenna 150 can cover a first frequency band FB1 from 2496 MHz to 2690 MHz, and a second frequency band FB2 from 3300 MHz to 3800 MHz. Therefore, the antenna system 100 can support at least the wideband operation of sub-6 GHz frequency intervals of the next-generation 5G communication (e.g., the N41 and N78 frequency bands). Furthermore, within the first frequency band FB1 and the second frequency band FB2, the isolation between the first antenna 110 and the second antenna 150 can reach at least 10 dB.

Figure 4:
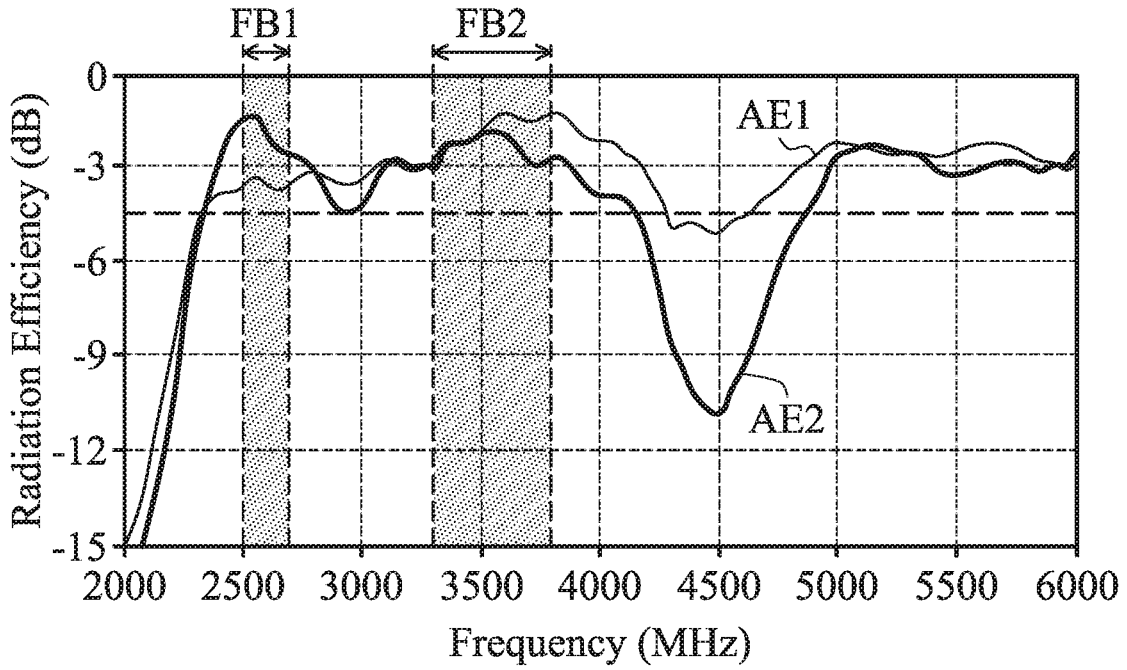
FIG. 4 is a diagram of radiation efficiency of an antenna system according to an embodiment of the invention.

FIG. 4 is a diagram of radiation efficiency of the antenna system 100 according to an embodiment of the invention. The horizontal axis represents the operation frequency (MHz), the vertical axis represents the radiation efficiency (dB). FIG. 4 illustrates a first radiation efficiency curve AE1 relative to the first antenna 110, and a second radiation efficiency curve AE2 relative to the second antenna 150. According to the measurement of FIG. 4, within the first frequency band FB1 and the second frequency band FB2, the radiation efficiency of each of the first antenna 110 and the second antenna 150 can reach at least −4 dB, and it can meet the requirements of practical application of general mobile communication.

In some embodiments, the operation principles of the antenna system 100 are described as follows. In the first antenna 110, the first feeding element 120 and the first radiation element 130 are excited to generate the first frequency band FB1, and the first feeding element 120 and the shorting element 140 are excited to generate the second frequency band FB2. In the second antenna 150, the second feeding element 160 and the second radiation element 170 are excited to generate the second frequency band FB2, and the second feeding element 160 and the third radiation element 180 are excited to generate the first frequency band FB1. According to practical measurement, the first parasitic element 210 and the second parasitic element 220 can attract undesired resonant currents, and they can help to enhance the isolation between the first antenna 110 and the second antenna 150, such that the first antenna 110 and the second antenna 150 do not tend to interfere with each other.

Figure 5A:
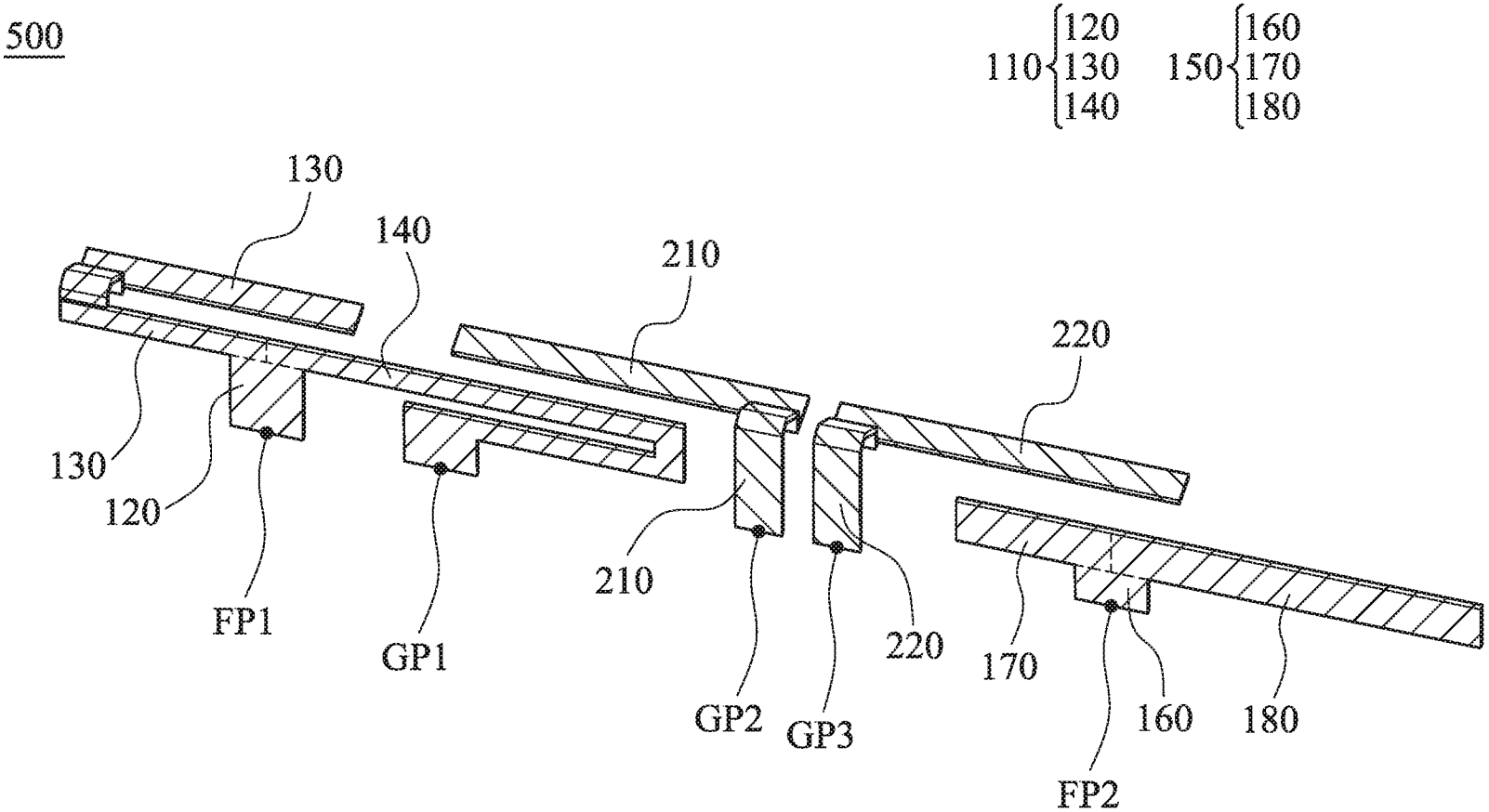
FIG. 5A is a perspective view of an antenna system according to another embodiment of the invention.
Figure 5B:
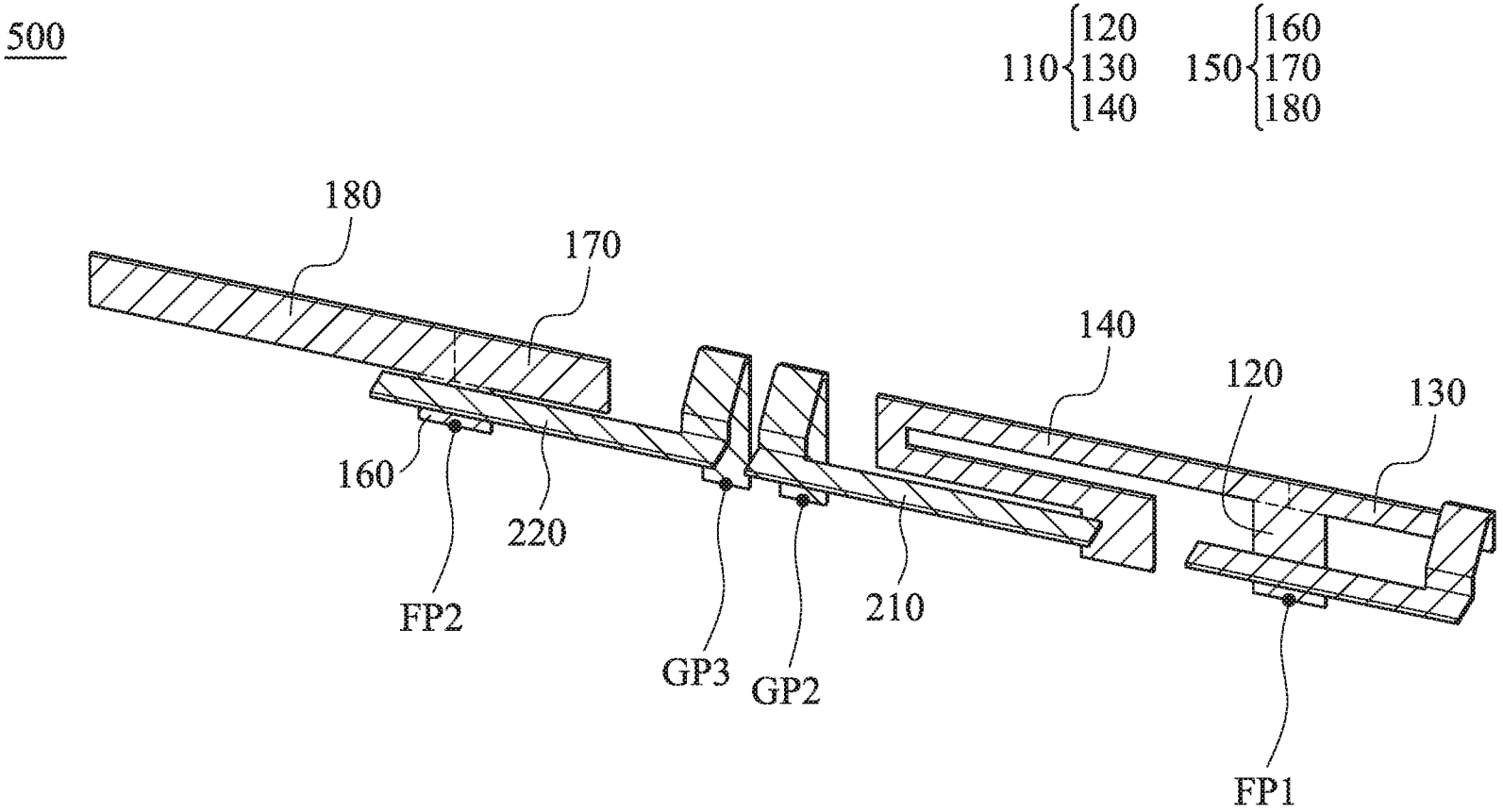
FIG. 5B is a perspective view of an antenna system according to another embodiment of the invention.

In some embodiments, the element sizes of the antenna system 100 are described as follows. The total length L1 of the first feeding element 120 and the first radiation element 130 (i.e., the total length L1 from the first end 121 through the second end 122 and the first end 131 to the second end 132) may be from 0.15 to 0.2 wavelength (0.15λ~0.2λ) of the first frequency band FB1. The total length L2 of the first feeding element 120 and the shorting element 140 (i.e., the total length L2 from the first end 121 through the second end 122 and the second end 142 to the first end 141) may be from 0.3 to 0.4 wavelength (0.3λ~0.4λ) of the second frequency band FB2. The total length L3 of the second feeding element 160 and the second radiation element 170 (i.e., the total length L3 from the first end 161 through the second end 162 and the first end 171 to the second end 172) may be from 0.1 to 0.12 wavelength (0.1λ~0.12λ) of the second frequency band FB2. The total length L4 of the second feeding element 160 and the third radiation element 180 (i.e., the total length L4 from the first end 161 through the second end 162 and the first end 181 to the second end 182) may be from 0.12 to 0.14 wavelength (0.12λ~0.14λ) of the first frequency band FB1. The distance D1 between the first parasitic element 210 and the second parasitic element 220 may be from 1.1 mm to 2 mm. The length LA of the first parasitic element 210 (i.e., the length LA from the first end 211 to the second end 212) may be from 0.24 to 0.26 wavelength (0.24λ~0.26λ) of the second frequency band FB2. The length LB of the second parasitic element 220 (i.e., the length LB from the first end 221 to the second end 222) may be from 0.24 to 0.26 wavelength (0.24λ~0.26λ) of the second frequency band FB2. The width of the first coupling gap GC1 may be from 2.8 mm to 3.6 mm. The width of the second coupling gap GC2 may be from 2.8 mm to 3.6 mm. The above ranges of elements are calculated and obtained according to many experimental results, and they help to optimize the isolation, the operation bandwidth, and the impedance matching of the antenna system 100. FIG. 5A is a perspective view of an antenna system 500 according to another embodiment of the invention. FIG. 5B is a perspective view of the antenna system 500 according to another embodiment of the invention (from a different viewing angle). In the embodiment of FIG. 5A and FIG. 5B, the antenna system 500 is distributed over a nonconductive supporting element with a 3D and irregular shape (not shown) to be consistent with different environmental conditions. According to practical measurement, such an arrangement can increase the design flexibility, but does not negatively affect the radiation performance of the antenna system 500. Other features of the antenna system 500 of FIG. 5A and FIG. 5B are similar to those of the antenna system 100 of FIGS. 1 and 2. Therefore, the two embodiments can achieve similar levels of performance.

The invention proposes a novel antenna system. In comparison to the conventional design, the invention has at least the advantages of small size, wide bandwidth, high isolation, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-5. The invention may include any one or more features of any one or more embodiments of FIGS. 1-5. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna system, comprising:

a first antenna, comprising:

a first feeding element, having a first feeding point;

a first radiation element, coupled to the first feeding element; and a shorting element, wherein the first feeding element is coupled through the shorting element to a first grounding point;

a second antenna, comprising:

a second feeding element, having a second feeding point;

a second radiation element, coupled to the second feeding element; and a third radiation element, coupled to the second feeding element, wherein the second radiation element and the third radiation element substantially extend in opposite directions;

a first parasitic element, coupled to a second grounding point; and a second parasitic element, coupled to a third grounding point, wherein the first parasitic element and the second parasitic element are disposed between the first antenna and the second antenna, and the first parasitic element and the second parasitic element substantially extend away from each other;

wherein the first antenna and the second antenna cover a first frequency band and a second frequency band;

wherein a total length of the first feeding element and the first radiation element is from 0.15 to 0.2 wavelength of the first frequency band.

2. The antenna system as claimed in claim 1, further comprising:

a nonconductive supporting element, configured to support the first antenna, the second antenna, the first parasitic element, and the second parasitic element, wherein the nonconductive supporting element has a first surface and a second surface which are not parallel to each other.

3. The antenna system as claimed in claim 2, wherein the first radiation element extends from the first surface onto the second surface of the nonconductive supporting element.

4. The antenna system as claimed in claim 2, wherein the shorting element is positioned on the first surface of the nonconductive supporting element.

5. The antenna system as claimed in claim 2, wherein the second radiation element is positioned on the first surface of the nonconductive supporting element.

6. The antenna system as claimed in claim 2, wherein the third radiation element is positioned on the first surface of the nonconductive supporting element.

7. The antenna system as claimed in claim 2, wherein the first parasitic element extends from the first surface onto the second surface of the nonconductive supporting element.

8. The antenna system as claimed in claim 2, wherein the second parasitic element extends from the first surface onto the second surface of the nonconductive supporting element.

9. The antenna system as claimed in claim 1, wherein the first radiation element substantially has a U-shape.

10. The antenna system as claimed in claim 1, wherein the shorting element has a meandering shape.

11. The antenna system as claimed in claim 1, wherein the second radiation element substantially has a relatively short straight-line shape.

12. The antenna system as claimed in claim 1, wherein the third radiation element substantially has a relatively long straight-line shape.

13. The antenna system as claimed in claim 1, wherein the first parasitic element substantially has an inverted L-shape.

14. The antenna system as claimed in claim 1, wherein the second parasitic element substantially has an L-shape.

15. The antenna system as claimed in claim 1, wherein the first frequency band is from 2496 MHz to 2690 MHz, and the second frequency band is from 3300 MHz to 3800 MHz.

16. The antenna system as claimed in claim 15, wherein a total length of the first feeding element and the shorting element is from 0.3 to 0.4 wavelength of the second frequency band.

17. The antenna system as claimed in claim 15, wherein a total length of the second feeding element and the second radiation element is from 0.1 to 0.12 wavelength of the second frequency band.

18. The antenna system as claimed in claim 15, wherein a total length of the second feeding element and the third radiation element is from 0.12 to 0.14 wavelength of the first frequency band.

19. The antenna system as claimed in claim 1, wherein a distance between the first parasitic element and the second parasitic element is from 1.1 mm to 2 mm.

* * * * *